US005732634A

United States Patent [19]

Flickinger et al.

[11] Patent Number: 5,732,634

[45] Date of Patent: Mar. 31, 1998

[54] THIN FILM BRIDGE INITIATORS AND METHOD OF MANUFACTURE

[75] Inventors: Joseph E. Flickinger; Brian E. Smith; Gary D. Moran, all of Hollister, Calif.

[73] Assignee: Teledyne Industries, Inc., Los Angeles, Calif.

[21] Appl. No.: 706,894

[22] Filed: Sep. 3, 1996

[51] Int. Cl.[6] ..... F42C 19/12

[52] U.S. Cl. ..... 102/202.5; 102/202.9; 102/202.7; 102/202.14

[58] Field of Search ..... 102/202.5, 202.7, 102/202.8, 202.9, 202.12, 202.14

[56] References Cited

U.S. PATENT DOCUMENTS

| | | | |
|---|---|---|---|
| 3,135,200 | 6/1964 | Jackson | 102/202.5 |
| 3,181,464 | 5/1965 | Parker et al. | 102/202.8 |
| 3,666,967 | 5/1972 | Keister et al. | 307/202 |
| 3,669,022 | 6/1972 | Dahn et al. . | |
| 3,763,782 | 10/1973 | Bendler et al. | 102/202.7 |
| 3,906,858 | 9/1975 | Craig et al. | 102/202.5 |
| 3,960,083 | 6/1976 | Dietzel et al. | 102/202.14 |
| 4,335,653 | 6/1982 | Bratt et al. | 102/202.8 |
| 4,409,898 | 10/1983 | Blix et al. . | |
| 4,708,060 | 11/1987 | Bickes, Jr. et al. . | |
| 4,729,315 | 3/1988 | Proffit et al. | 102/202.9 |
| 4,819,560 | 4/1989 | Patz et al. . | |
| 4,893,563 | 1/1990 | Baginski | 102/202.2 |
| 4,924,774 | 5/1990 | Lenzen . | |
| 4,976,200 | 12/1990 | Bensen et al. . | |
| 5,544,585 | 8/1996 | Duguet | 102/202.5 |

FOREIGN PATENT DOCUMENTS

WO 9419661 1/1994 WIPO .

*Primary Examiner*—Michael J. Carone
*Assistant Examiner*—Christopher K. Montgomery
*Attorney, Agent, or Firm*—David H. Semmes

[57] ABSTRACT

A thin film bridge initiator for initiation of explosives includes a thin film resistive element of a selected composition of Nichrome, alternately Tantalum Nitride either of which is evaporated upon (in the case of Nichrome) or sputtered upon (in the case of Tantalum Nitride) an alumina substrate. A prime explosive mix is contained against the initiator film elements by a positive retention contactor assembly.

10 Claims, 3 Drawing Sheets

THIN FILM BRIDGE INITIATORS AND METHOD OF MANUFACTURE

BACKGROUND OF THE INVENTION

Thin film bridge initiators are broadly useful as actuators for the detonation of explosives. In automotive safety per se, passenger protection against accident impact has evolved into development of pyrotechnic actuated pressure cartridges for seat belt pretensioners and airbags. More specifically, the present invention relates to a pyrotechnic pressure cartridge or igniter utilizing a thin film resistive element on ceramic that provides fast functioning, low energy initiation of a pyrotechnic material. The term "Thin Film Resistive Element" refers herein to any resistive element such as Tantalum Nitride or Nichrome (nickel/chromium), that is evaporated, sputtered, or otherwise deposited onto a ceramic or other coatable material. While semiconductor bridge and traditional bridgewire devices are satisfactory in many respects, they do not meet all of the following criteria characterized herein as: fast functioning i.e. less than 100 microseconds from application of power; low energy consumption, viz less than one millijoule; extreme electrostatic discharge (ESD) robustness, viz 24 amperes peak, 1150 watts dissipation, within 0.1 microsecond, and; have a very stable resistance during application of firing energy.

The Thin Film Bridge herein, known as TFB, is electrically equivalent to a resistor. When measured with an ohmmeter its resistance reads a value determined by its geometry, viz length, width, and thickness of the resistive element. The nominal value for the present circuitry is two ohms, but other approximate values are possible by varying the bridge geometry. The thermal coefficient of resistance is very low, i.e. its resistance change is very minute with temperature variation. Finally, its resistance from d.c. to several hundred megahertz remains stable with no reactive components present. In summary, the TFB is a very stable, predictable, simple electrical component which can be modeled as a standard resistor, even as it heats up during the firing pulse.

To the end user, the TFB appears to be a simple resistor, up until the point of ignition of the powder. At lower firing currents the bridge temperature reaches the ignition temperature of the powder before it reaches the melting point of the resistive bridge. Ignition occurs and the bridge is either destroyed by the reaction or eventually fused (burned open) by the firing current. At higher firing currents, in the all-fire region, the bridge temperature increases rapidly to the point of vaporization of the resistive bridge. When this occurs, a plasma is projected into the powder to start the ignition process.

Within this technological jump from conventional bridgewire technology to the TFB, 100 microseconds has been set herein as the upper limit for function lime. More specifically, all sensitivity testing, and all-fire specifications will base successful initiation on igniting the powder in less than 100 microseconds, with a nominal time of 50 microseconds. The chart below highlights the advantages of the TFB over the Semi-Conductor Bridge (SCB) and Conventional Bridgewire devices now in the marketplace.

COMPARISON OF SCB AND HOT-WIRE DEVICE TO THE PRESENT TFB

| | BRIDGEWIRE | SCB (61A2) | TFB (3Z2) |
|---|---|---|---|
| Energy Consumed | 5–6 mJ | 1.4 mJ | 0.8 mJ |
| CDU Energy | 9–10 mJ | 2–2.5 mJ | 1–1.5 mJ |
| No-fire Current | 0.20 A | 0.5 A | 0.8 A |
| Function Time | 400 microseconds | 70 microseconds | 40 microseconds |
| Resistance | 1.8–2.5 ohms | 1.8–2.5 ohms | 1.8–2.5 ohms |
| Sign of Resistivity Coefficient | Positive | Negative | Positive (small) |

PRIOR ART

Notable examples of related thin film bridges in the prior art follow.

U.S. Pat. No. 3,669,022 to Dahn, et al. issued Jun. 13, 1972 discloses a thin film bridging device which may be used as a fuse or a detonation initiation mechanism. The device comprises a layered thin film structure disposed between conductive layers, bridged with titanium or aluminum, and is limited to initiating activation of explosives such as PETN, RDX, HNS, etc.

U.S. Pat. No. 4,409,898 to Blix, et al. issued on Oct. 18, 1983 discloses an electric igniter for use with artillery ammunition.

U.S. Pat. No. 4,708,060 to Bickes, et al. issued on Nov. 24, 1987 discloses an igniter of a semiconductor nature suitable for ignition of explosives. The semiconductor bridge therein is a doped silicon on either a sapphire or silicon wafer.

U.S. Pat. No. 4,729,315 to Proffit, et al., Mar. 8, 1988 discloses a method of making a detonator utilizing an explosive containing shell having a bridge initiator. The process steps used to construct said bridge initiator are very similar to those used in semiconductor processing for beam lead devices. Said device also requires fixation in a slot on the header.

U.S. Pat. No. 4,819,560 to Patz, et al. issued on Apr. 11, 1989 discloses a detonating firing element which includes at least one of the following: a transistor, a field effect transistor, a four layer device, a zener diode, and a light emitting device. Further, this detonator firing unit requires integrated circuitry for controlling the actuation of the detonator firing element.

U.S. Pat. No. 4,924,774 to Reiner Lenzen, May 15, 1990 discloses an ignitable pyrotechnic transmission line, whose output sheath is made of either plastic material or polyvinylchloride, activated by a semiconductor bridge capable of actuating an airbag inflator or a seat belt pretensioner.

U.S. Pat. No. 4,976,200 to Benson, et al., Dec. 11, 1990 discloses a tungsten film bridge igniter, implanted on a silicon or sapphire substrate, utilizing chemical vapor deposition techniques.

International Patent WO94/19661 to Willis, et al., Sep. 1, 1994 discloses a method of fabricating and packaging an electroexplosive device which uses doped silicon or tantalum film on intrinsic silicon. It further encompasses redundant bondwires and plated/filled through-holes, known as via's, through the silicon chip itself.

SUMMARY OF INVENTION

To those familiar with the art, this invention provides the assemblage and technique to fabricate inexpensive, fast functioning, low-energy initiators, incorporating an ESD robustness not currently found in the commercial marketplace today. Notably in the preparation of the present thin film based resistive igniter, no styphnate-based material is required. Two different resistive element compositions, Nichrome and Tantalum Nitride, $Ta_2N$, are characterized herein. The preselected resistive composition is either thermally evaporated or sputtered onto an alumina substrate, depending upon the material and the process preference; viz Nichrome is thermally evaporated.

In the method of manufacture, a thin film resistive element/resistor chip is attached to a header hereinafter shown and connected to an enabling circuit by way of two or more aluminum wires. Utilizing standard microelectronic processes, one 2.0 inch by 2.0 inch wafer will yield approximately 900 of these circuits, each essentially identical to the other. Included in the objectives of invention are: achievable multiple parallel functioning and easy modeling of the electrical load. Moreover, the technique of assemblage of this pyrotechnic gas generator applies to both dry or slurry powder loading techniques.

During the firing of a Thin Film Bridge herein, performance is influenced by the volume of the bridge, its contact with the alumina ceramic below, and the explosive powder mix in intimate contact above the surface of the resistive element, itself. Heating occurs internally within the bridge volume when the current reacts with the bridge resistance. Power is generated in accordance with $I^2R$. The temperature of the bridge then increases as with any resistive heating element, the temperature increase for a given firing current being governed by the mass and specific heat of the bridge. By adjusting the format to a different surface area vs. volume ratio, the temperature rise can be manipulated to produce a variety of firing sensitivities and tolerances to electrical hazards such as Electro-Static Discharge, No-Fire Currents, and various Radio Frequency (r.f.) Exposures.

As will appear below, the primary objective of invention, as applied to the automotive safety market is to decrease the firing time and energy requirements necessary to activate pyrotechnic cartridges in airbag and similar safety devices.

Other objectives in the manufacture and utilization of the pyrotechnic initiator product of invention include the following:

- The creation of a thin film initiator that possesses an ESD robustness which is demonstrated by passing both a 500 picofarad, 25 kilovolt electrostatic discharge through a 5,000 ohm resistor and a 150 picofarad, 8 kilovolt electrostatic discharge through a 330 ohm resistor, without any measurable degradation in performance.
- The selective presentation, of a pretensioner cartridge/airbag type initiator that does not require the use of nickel or other diffusion barrier material in its construction.
- The selective presentation of a pretensioner/airbag type initiator that is suitable for traditional bridgewire style systems.
- The advanced method of fabricating thin film bridge circuits according to the invention whereby one may inexpensively fabricate many thin film bridge initiator circuits, all essentially identical using standard thin film processes common in the microelectronics industry.
- The selective presentation of pretensioner/airbag initiators according to the invention which do not require the use of a styphnate based material.
- The selective presentation of a pretensioner cartridge/airbag initiator that performs equally well regardless of header diameter.
- The selective presentation of a pretensioner/airbag initiator that has an application for commercial blasting and oil well usage, which will require reduced energy and provide repeatable function time.

DESCRIPTION OF PREFERRED EMBODIMENTS

Figure 1:
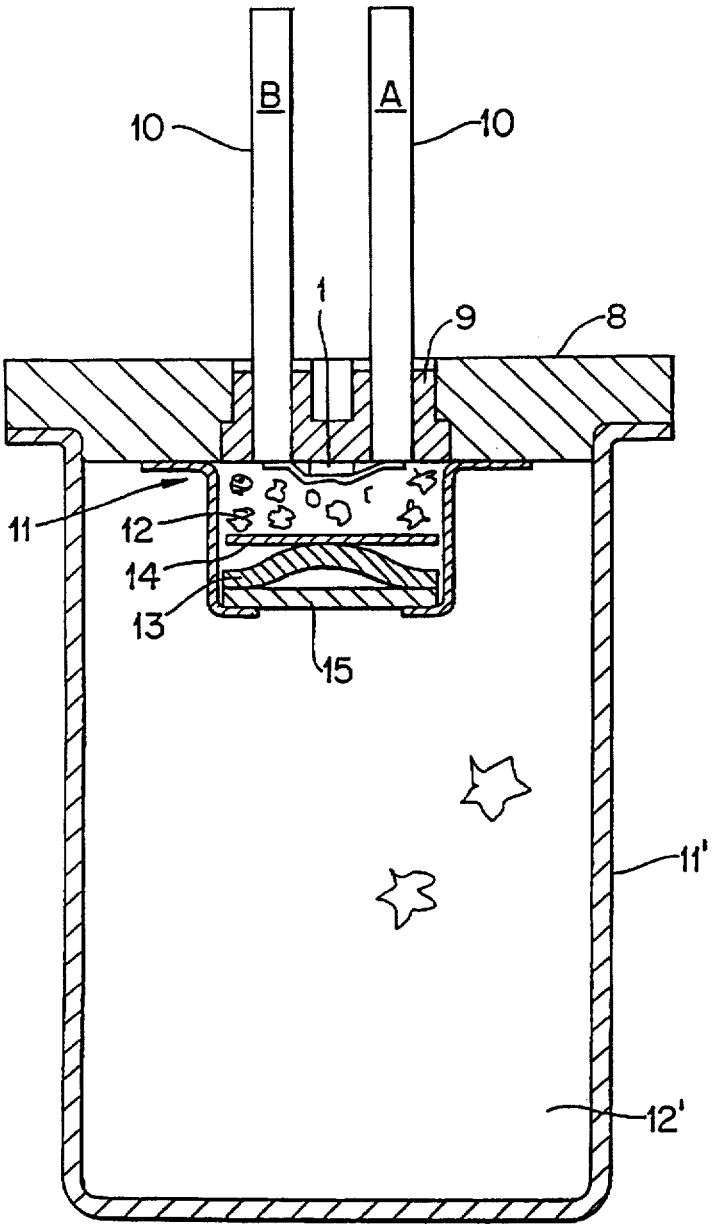
FIG. 1 is a schematic side view of a thin film bridge (TFB) pyrotechnic pressure cartridge including a header assembly, manufactured in accordance with the invention technique, reference FIG. 4 below.

FIG. 1 illustrates a film bridge, TFB, pyrotechnic pretensioner cartridge with a positive, powder retention, mechanism 11, which in this invention is a requirement for the successful and consistent transfer of initiation stimulus from the thin film bridge to the pressed prime powder/explosive mix.

The prime/explosive mix 12 of this invention within the loaded header assembly 8 includes hydroborate based materials. Titanium Subhydride Potassium Perchlorate ($TiH_{1.65}KClO_4$), Zirconium Potassium Perchlorate, and any other material capable of initiation using heat conduction or transmission can be used.

The positive retention mechanism 11 is thus a requirement for the consistent transfer of initiation stimulus from the thin film bridge 1 to the pressed powder/explosive mix 12. The positive retention/compressive forces come into play as follows: the prime mix 12 is consolidated around the thin film bridge 1 and electrical conductors 10, shown as PINS A and B in FIG. 1A. During various environmental exposures, this consolidated prime mix tends to lift away from the thin film bridge, TFB, hence the need for a positive retention or constant compressive force.

The compactor, which is required for this purpose, consists of a positive retention device 13, a wavy washer sic, contained between auxiliary powder plate 14 and compression plate 15. As was demonstrated in Experiments Numbers 1 and 2 described hereinafter, any positive retention is preferred to none, with the wavy washer compactor 13 providing the optimum compressive force. The presence of a positive and continuous compressive force maintaining intimate contact between the explosive mix and the resistive bridge element 1 accordingly ensures a highly reliable transfer of initiation energy and reproducible firing characteristics.

Figure 1A:
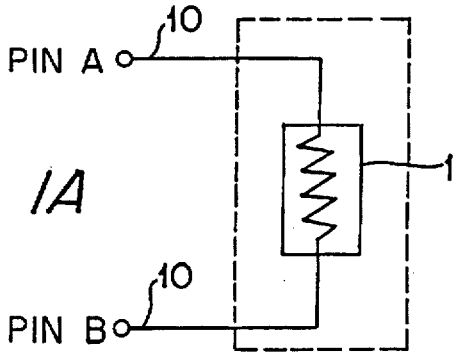
FIG. 1A schematically depicts an enabling circuit therefor.
Figure 4:
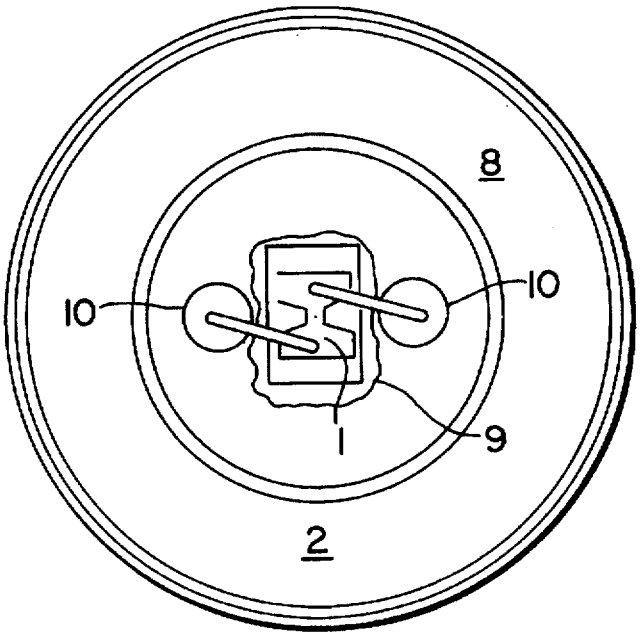
FIG. 4 is a top view of the attachment of the thin film resistive element/resistor chip to the header assembly.

The pyrotechnic pressure cartridge includes a loaded header assembly 8, through which pass conductive pins; see FIG. 1A. Pins A and B therein have contact with film resistance bridge, FRB 1, yielding a resistance of 1.80–2.40 ohms. See also FIG. 4 illustrating the thin film resistive element 1 and header assembly 8.

Figure 2:
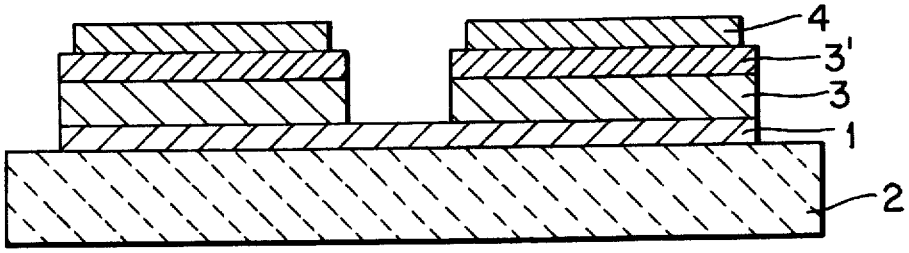
FIG. 2 is an expanded cross-section of the thin film resistive element, herein.

FIG. 2 is an expanded cross-section of a typical film resistive element FRB 1. The base substrate/ceramic wafer 2 is typically 0.025" thick fine or ultra fine $Al_2O_3$. The first step in production is the sputtering or thermal evaporation of the selected resistive layer 1 to achieve a sheet resistivity of 0.1 to 20 ohms per square. Nichrome is thermally evaporated upon the substrate, $Al_2O_3$, 99.6% pure; whereas Tantalum Nitride, $Ta_2N$, if alternately selected, is sputtered onto the 0.025" thick alumina $Al_2O_3$. During either the sputtering or evaporation process, a seed layer of pure gold 3, in the neighborhood of (0.6 to 200 microinches is also similarly applied. The final layer of gold 4 or other suitable metal, e.g. such as aluminum or platinum which enables a bonding with aluminum wire 10, is then electroplated on, to a thickness desired to support external aluminum pin/wire bonding. The plated substrate is then subjected to a series of photolithography and etching steps to remove the unwanted material, yielding a wafer of completed resistive elements, which can then be diced up, attached and wirebonded to a suitable header assembly 8 such as appears in FIG. 4. Significantly, these header assemblies may vary in diameter to accommodate a variety of applications.

Figure 3:
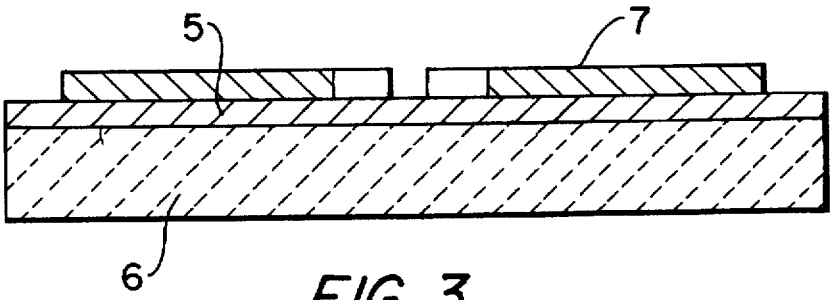
FIG. 3 (PRIOR ART)
FIG. 3 is an expanded cross-section of a prior art, generic Semiconductor Bridge (SCB).

FIG. 3 is an expanded cross-section of a typical, prior art, Semiconductor Bridge (SCB). The starting material for the SCB manufacturing process consists of a thin, intrinsic silicon film 5, in the neighborhood of 2 micrometers thick, that has been epitaxially grown on either a sapphire 6 or single crystal silicon wafer approximately 500 micrometers thick. The first step in the fabrication of an SCB consists of uniformly doping the thin silicon film 5 to obtain the desired conductivity, resistance. The doping process typically consists of diffusing varying impurities at some high temperature, followed by either sputtering or evaporating the bonding layer 7, typically aluminum, onto the previously doped silicon film 5. The wafer then is subjected to a series of photolithography and etching steps to remove the unwanted material, yielding a wafer of completed Semiconductor Bridges, which can be diced up, attached and wirebonded to the next higher assembly. A major disadvantage of this technology is the wide variation in resistance values that occurs during heating. The bridge resistance will typically double from its initial value, then drop to nearly one half its initial value as the melting point of the bridge is reached.

In contrast, the selective Nichrome and Tantalum Nitride thin film bridges herein have extremely stable resistances when heated. Likewise, multiple units may easily be fired from a common energy source with the overall resistive load being easily predicted at any instant.

FIG. 4 depicts the resistive thin film attachment 1 to the surface of the header assembly 8 by way of either epoxy 9 or eutectic means. The wires 10 used to connect the thin film bridge are either single or multiple 0.001 to 0.020 inch diameter, aluminum. The preferred method of their attachment to the substrate is by way of ultrasonic wire bonding. It is critical to this invention that the wire bonding be at a temperature low enough to prevent the formation of intermetallic voiding, hence weakening the bond to substrate pad interface.

Figure 5:
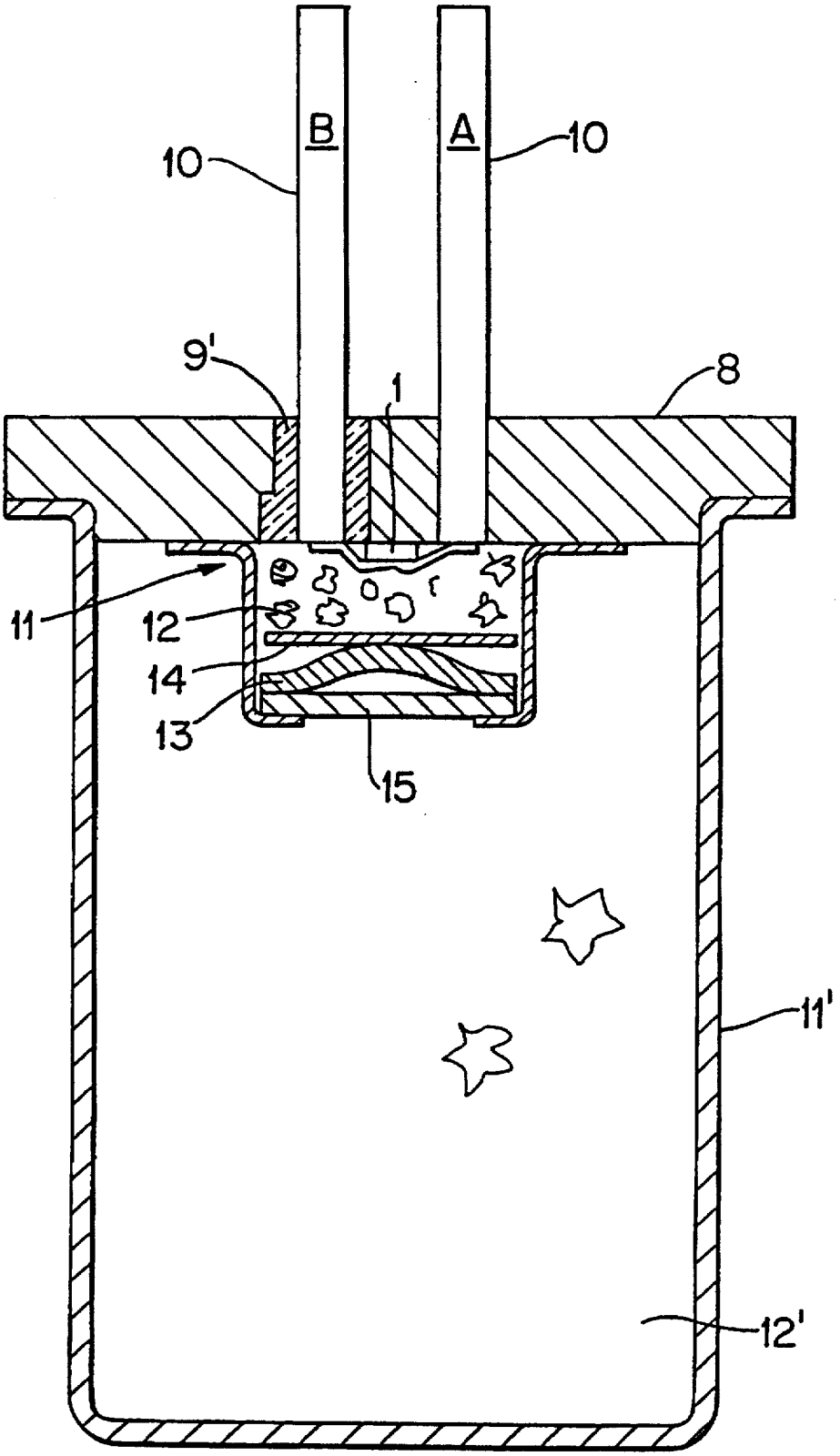
FIG. 5 is a schematic side view of a TFB similar to FIG. 1 and showing a coaxial header assembly modification.

FIG. 5 depicts a coaxial modification of header assembly 8, described above and illustrated in FIG. 1. Through the metal header 8, the right most electrical conductor PIN A is shown to be grounded, the same being embedded, at its confined end, in a dielectric, viz, glass.

The following experiments have been performed according to the preferred description of this invention:

EXPERIMENT NO. 1

An experiment was performed to demonstrate the effects of various positive retention mechanisms, including a silicone rubber compression pad, a magnesium dimpled closure, and a wavy washer concept. Several groups of pressure cartridges were manufactured with the previously mentioned positive retention concepts, and subjected to 200 cycles of temperature shock between −12° C. and +90° C. Listed below are the thin film bridge burnout times for these configurations.

| CONFIGURATION | AVERAGE BURNOUT −40° C. | AVERAGE BURNOUT +95° C. |
|---|---|---|
| No Positive Retention | 75 microseconds* | 67 microseconds* |
| Silicone Rubber Pad | 51 microseconds | 59 microseconds |
| Dimple Closure | 52 microseconds | 43 microseconds |
| Wavy Washer | 48 microseconds | 47 microseconds |

*Experienced failures to initiate.

EXPERIMENT NO. 2

A second experiment was conducted similar to Experiment No. 1 except that the thermal exposure consisted of 25 cycles of temperature shock between −65° C. and +125° C. The results are as listed below.

| CONFIGURATION | AVERAGE BURNOUT −40° C. | AVERAGE BURNOUT +95° C. |
|---|---|---|
| No Positive Retention | 74 microseconds* | 66 microseconds* |
| Silicone Rubber Pad | 56 microseconds | 58 microseconds |
| Dimple Closure | 48 microseconds | 41 microseconds |
| Wavy Washer | 46 microseconds | 43 microseconds |

*Experienced failures to initiate.

Testing indicated that without a positive retention mechanism in place, the function times, as determined by bridge burnout, are approximately 50% longer and failure to initiate may occur.

SUPPLEMENTAL EXPERIMENTS

Several additional experiments have been conducted with Thin Film Bridges, TFB, both with Nichrome and Tantalum Nitride resistive elements, and various Semiconductor Bridges (SCB), all in the 2 ohm nominal range. The SCB, using phosphorous as the dopant, were evaluated on both sapphire and silicon substrates, and had bridge geometries tailored for ESD robustness. The results are as listed below, along with a comparison in some cases of typical hot wire devices currently commercially available.

| BRIDGE CONFIGURATION | FUNCTION TIME (microseconds) | ENERGY CONSUMED (millijoules) | ESD ROBUSTNESS REGIMEN 1A | ESD ROBUSTNESS REGIMEN 2B |
|---|---|---|---|---|
| SCB Sapphire Substrate | 52 | 0.80 | Passed | Failed |
| SCB Silicon Substrate | 50 | 0.90 | Failed | Not Tested |
| Nichrome TFB | 50 | 0.62 | Passed | Passed |
| Tantalum Nitride TFB | 41 | 0.60 | Passed | Passed |
| Hot Wire Device | 400 | 5–6 | Passed | Passed |

Regimen 1A denotes a 500 picofarad capacitor charged to 25 kV, then discharged through a 5K ohm resistor into the test specimen. The discharge switch is defined as two approaching metal spheres.

Regimen 2B denotes a 150 picofarad capacitor charged to 8 kV, then discharged through a 330 ohm resistor into the test specimen, with a similar discharge switch.

Many modifications and variations of this invention are possible in light of the above teachings. For example, the utility of the invention described herein extends (in addition to automotive safety systems) to commercial aircraft as well as commercial blasting and oil well usage wherein reduced energy, smaller firesets and both repeatable and fast function times are sought. We therefore intend the above terminology to illustratively describe the invention's preferred embodiment and not to limit its scope. Within the scope of the appended claims, in which reference numerals are merely for convenience and are not limiting, one may practice the invention other than as the above specification describes.

The scope of invention is thus defined in the following claims, wherein we claim:

1. A selective, pyrotechnic pretensioner cartridge/air bag initiator comprising:

a) a loaded header assembly (8), securing opposed electrical conductors (10), said conductors being bonded to the header assembly by epoxy eutectic means (9) whereby to contact a superposed thin film bridge, said bridge including a resistive layer (1) having a sheet resistivity of 0.1 to 20 ohms;

b) a prime explosive mix (12) contained by a positive retention compactor assembly (11), said assembly consisting of a contained powder retention device (13) which is disposed between an auxiliary powder plate (14) and a compressive plate (15);

c) an output shell (11') connected to the header assembly (8), the output shell containing an output load of explosive (12') which is retained in detonateable relation to the explosive mix (12);

d) a source of electric power connected to the resistive layer (1).

2. A selective, pyrotechnic pretensioner cartridge/airbag initiator according to claim 1 including dielectric ground means (9') connecting one said electrical conductor (10) to the thin film bridge.

3. The selective pyrotechnic pretensioner cartridge/airbag initiator of claim 2 wherein the ground means is comprised of glass.

4. The selective pyrotechnic pretensioner cartridge/airbag initiator according to claim 1 comprising:

a) a ceramic, alumina substrate (2), having a thickness which is 0.025 inches;

b) a one-to-two micron thick resistive layer (1) of a preselected metal based composition, spanning other bonded metal films;

c) first gold film seed layer, thermally evaporated upon the resistive layer (1) to a thickness of 0.6 to 200 microinches;

d) a film of gold plate (4), electroplated upon the first gold film.

5. The thin film initiator of claim 4 wherein the resistive layer (1) is Nichrome.

6. The thin film initiator of claim 4 wherein the resistive layer (1) is Tantalum Nitride.

7. The pyrotechnic pretensioner cartridge of claim 4 wherein the prime explosive mix (12) includes a hydroborate based composition, capable of ignition.

8. A selective pyrotechnic pretensioner cartridge/airbag initiator according to claim 4 including dielectric ground means (9') connecting one said electrical conductor (10) to the thin film bridge.

9. The selective pyrotechnic pretensioner cartridge/air bag initiator of claim 8 wherein the ground means is comprised of glass.

10. The pyrotechnic pretensioner cartridge of claim 1 wherein the prime explosive mix (12) includes a hydroborate based composition, capable of ignition.

* * * * *